US008398009B2

(12) United States Patent
Vihma et al.

(10) Patent No.: US 8,398,009 B2
(45) Date of Patent: Mar. 19, 2013

(54) BLADE MADE OF STEEL ALLOY

(75) Inventors: Karri Vihma, Valkeakoski (FI); Johan Norberg, Ekshärad (SE)

(73) Assignee: Metso Paper, Inc., Helsinki (FI)

( * ) Notice: Subject to any disclaimer, the term of this patent is extended or adjusted under 35 U.S.C. 154(b) by 341 days.

(21) Appl. No.: 12/921,542

(22) PCT Filed: Mar. 19, 2009

(86) PCT No.: PCT/FI2009/050211

§ 371 (c)(1),
(2), (4) Date: Sep. 8, 2010

(87) PCT Pub. No.: WO2009/115647

PCT Pub. Date: Sep. 24, 2009

(65) Prior Publication Data

US 2011/0024540 A1 Feb. 3, 2011

(30) Foreign Application Priority Data

Mar. 19, 2008 (FI) ..... 20085236

(51) Int. Cl.
*B02C 7/11* (2006.01)

(52) U.S. Cl. ..... 241/261.1; 241/261.2; 241/293; 241/298

(58) Field of Classification Search ..... 241/293, 241/296, 297, 298, 261.2, 261.3, 261.1; 420/11, 420/12, 69, 70
See application file for complete search history.

(56) References Cited

U.S. PATENT DOCUMENTS 4,604,781 A * 8/1986 Rankin, III ..... 29/402.07
4,870,931 A 10/1989 Nakamura et al.
5,824,265 A 10/1998 Dodd

FOREIGN PATENT DOCUMENTS

JP 5320818 12/1993

OTHER PUBLICATIONS

International Search Report issued in PCT/FI2009/050211.
Written Opinion of the International Searching Authority issued in PCT/FI2009/050211.
Comments to the Written Opinion of the International Searching Authority Made by Applicant in PCT/FI2009/050211.
International Preliminary Report of Patentability issued in PCT/FI2009/050211.

* cited by examiner

*Primary Examiner* — Mark Rosenbaum
(74) *Attorney, Agent, or Firm* — Stiennon & Stiennon

(57) ABSTRACT

A refiner or disperser blade is made of a steel alloy by casting. The alloy comprises, in weight percent: 0.6 to 4 wt-% carbon (C), 0.5 to 1.5 wt-% silicon (Si), 0.4 to 1.5 wt-% manganese (Mn), 12 to 28 wt-% chromium (Cr), 4 to 12 wt-% niobium (Nb), as well as iron (Fe).

33 Claims, 3 Drawing Sheets

BLADE MADE OF STEEL ALLOY

CROSS REFERENCES TO RELATED APPLICATIONS

This application is a U.S. national stage application of International App. No. PCT/FI2009/050211, filed Mar. 19, 2009, the disclosure of which is incorporated by reference herein, and claims priority on Finnish App. No. 20085236, filed Mar. 19, 2008, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a blade made of steel alloy and more specifically, to a blade of a refiner or a disperser.

Stainless steels are steels having a chromium concentration higher that 12 wt-%. The corrosion resistance of stainless steel is good, which is based on the chromium oxide layer forming onto the steel surface and protecting the underlying steel from corrosion. By changing the composition of steel, i.e. alloy elements and their quantities, the crystal structure of stainless steel can be adjusted. Different crystal structures produce different properties in the steel.

One crystal structure of stainless steel is martensitic crystal structure. The martensitic crystal structure is achieved when the steel alloy is rapidly cooled and carbon does not have time to leave the interstitial sites of austenitic steel and the crystal structure turns into martensitic in the phase transition. Martensitic steel is one of the hardest and strongest steel types. In addition, it has the lowest ductility, i.e. steel having martensitic crystal structure is one of the most brittle steel types. However, this type of steel has good abrasion resistance which is mainly based on hard carbides formed by chromium and carbon, as well as strong martensitic matrix.

The abrasion resistance of martensitic stainless steel can be improved by increasing the carbon content of the steel alloy in which case the amount of chromium carbides in the structure increases. However, the carbon content cannot be increased infinitely because when the carbon content of the alloy increases, its impact ductility decreases. This is because the chromium carbides separate as the steel solidifies from the final melt wherein a carbide lattice is formed in the structure. Fractures developed in a steel product progress along the hard and brittle carbide lattice easily all the way through the whole structure. The greater the chromium carbide content in the structure, the more easily the fracture develops and progresses.

Applications of the invention include the blades of mechanical pulp refiners, low consistency refiners, fibreboard refiners and dispersers. These blades can be formed of two or more rotationally symmetrical cast pieces with the shape of a plate, cylinder or cone or combinations of these blade shapes placed against each other. Said blades can be alternatively formed of smaller parts such as segments of a circle, a cone or a cylinder which are combined to form a rotationally symmetric blade surface.

The surfaces of the blades of refiners and dispersers to be fitted against each other consist of blade bars and grooves. During refining the pulp suspension or wood chips fed between the refiner blades are guided between the blades over the refiner blades to the opposite side in respect of the feeding edge and from there onward in the process.

The refiner blades are under constant abrasion during the grinding. The lifetime of the blades is also decreased by foreign particles such as sand, glass and metals or paper fillers that end up between the refiner blades.

At present, refiner blades are manufactured from steel alloys with low, medium and high carbon content. Steel alloys with high carbon content have been presented in, for example, WO patent publication 01/68260 and EP patent application 1507023. A disadvantage of these martensitic stainless steels with medium and, in particular, high carbon content is that they have a high content of chromium carbide resulting in a uniform and thick carbide lattice and thereby low impact ductility and brittle structure. The problem with high carbon steel is essentially greater than low carbon steel having a smaller chromium carbide content, wherein a uniform carbide lattice does not form or it remains very thin.

SUMMARY OF THE INVENTION

It is an aim of the present invention to provide a refiner or disperser blade made of a steel alloy that has high abrasion resistance and impact ductility.

The invention is based on the idea that in order to improve the abrasion resistance of high carbon content steel, carbide formers are added which diffuse out of the melt in the early phases and/or during the solidification. Thus, the forming carbides do not form lattice-like structures, and consequently do not reduce the impact ductility of the material. The carbide former is selected so that the hardness of produced carbides is as great as possible. In addition, its affinity to oxygen has to be small wherein its oxidation does not complicate casting. A suitable carbide former for this purpose is niobium.

Using niobium as a carbide former in a steel alloy which is used as material for refiner blades when forming a martensitic structure, the abrasion resistance of refiner blades can be improved without decreasing their impact ductility at the same time.

Therefore, it is essential to replace chromium carbides with niobium carbides. In the solution of the invention, instead of a chromium carbide lattice, niobium carbides are formed which settle into the structure in such a manner that they do not weaken the ductility of the structure to a significant extent. Niobium carbides are harder than chromium carbides so the abrasion resistance is increased at the same time. By optimizing the steel composition according to the present invention, the chromium carbide lattice can be replaced with niobium carbides.

In the manufacturing process of the blade by casting, niobium carbides become evenly distributed in the structure according to a preferred embodiment.

The above-defined aims and advantages are achieved with a steel alloy with the following chemical composition, given in weight percent:

0.6 to 4 wt-% C, preferably 0.8 to 3.5 wt-% and most preferably 1.0 to 3.2 wt-%, 0.5 to 1.5 wt-% Si, preferably 0.8 to 1.0 wt-%, 0.4 to 1.5 wt-% Mn, preferably 0.7 to 0.8 wt-%, 12 to 28 wt-% Cr, preferably 13 to 26 wt-% and most preferably 14 to 24 wt-%, 4 to 12 wt-% Nb, preferably 4.5 to 10 wt-% and most preferably 5.0 to 8.0 wt-%, the rest is being constituted of Fe (as well as possible impurities).

The above-presented chemical compositions can also be indicated as follows:

Carbon (C) is present in an amount of at least 0.6 wt-%, preferably at least 0.8 wt-% and most preferably at least 1.0 wt-%. The amount of carbon is not more than 4 wt-%, preferably not more than of 3.5 wt-% and most preferably not more than of 3.2 wt-%.

Silicon is present in an amount at least 0.5 wt-% and preferably at least 0.8 wt-%. The amount of silicon is not more than 1.5 wt-% and preferably not more than 1.0 Wt-%.

Manganese (Mn) is present in an amount at least 0.4 wt-% and preferably at least 0.7 wt-%. The amount of manganese is not more than 1.5 wt-% and preferably not more than 0.8 wt-%.

Chromium (Cr) is present in an amount of at least 12 wt-%, preferably at least 13 wt-% and most preferably at least 14 wt-%. The amount of chromium is not more than 28 wt-%, preferably not more than 26 wt-% and most preferably not more than 24 wt-%.

To ensure the corrosion resistance of the material, chromium/carbon ratio (Cr/C) is at least 7. Chromium/carbon ratio can be lower than that if lower corrosion resistance can be accepted.

Niobium (Nb) is present in an amount of at least 4 wt-%, preferably at least 4.5 wt-% and most preferably at least 5.0 wt-%. The amount of niobium is not more than 12 wt-%, preferably not more than 10 wt-% and most preferably not more than 8 wt-%.

The necessary elements of the steel alloy have been listed above. In addition to them, the alloy may contain impurities, which is often the case. The steel alloy can also contain nickel and/or molybdenum.

If the steel alloy contains nickel, its content is not more than 2.5 wt-%, preferably 0.5 to 2.2 wt-% and most preferably 1.0 to 2.0 wt-%. Thus, the steel alloy contains at least 0.5 wt-% and most preferably at least 1.0 wt-% nickel. The steel alloy contains not more than 2.5 wt-%, preferably not more than 2.2 wt-% and most preferably not more than 2.0 wt-% nickel.

If the steel alloy contains molybdenum, its content is not more than 2.0 wt-%, preferably 0.2 to 1.5 wt-% and most preferably 0.3 to 0.9 wt-%. Thus, the steel alloy contains at least 0.2 wt-% and most preferably at least 0.3 wt-%. The steel alloy contains not more than 2.0 wt-%, preferably not more than 1.5 wt-% and most preferably not more than 0.9 wt-% molybdenum.

BRIEF DESCRIPTION OF THE DRAWINGS

The invention will be described in the following with reference to the accompanying drawings.

DESCRIPTION OF THE PREFERRED EMBODIMENTS

Figure 1:
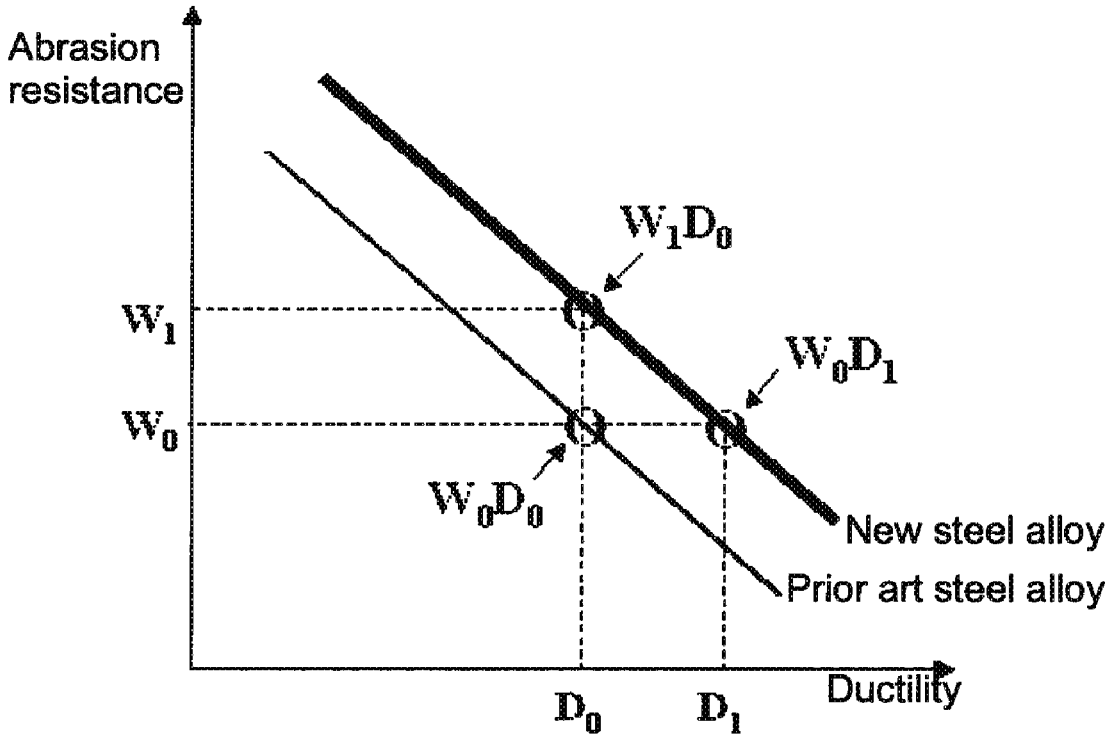
FIG. 1 shows the abrasion resistance as a function of ductility of a steel alloy according to prior art and a steel alloy according to the invention.
Figure 2:
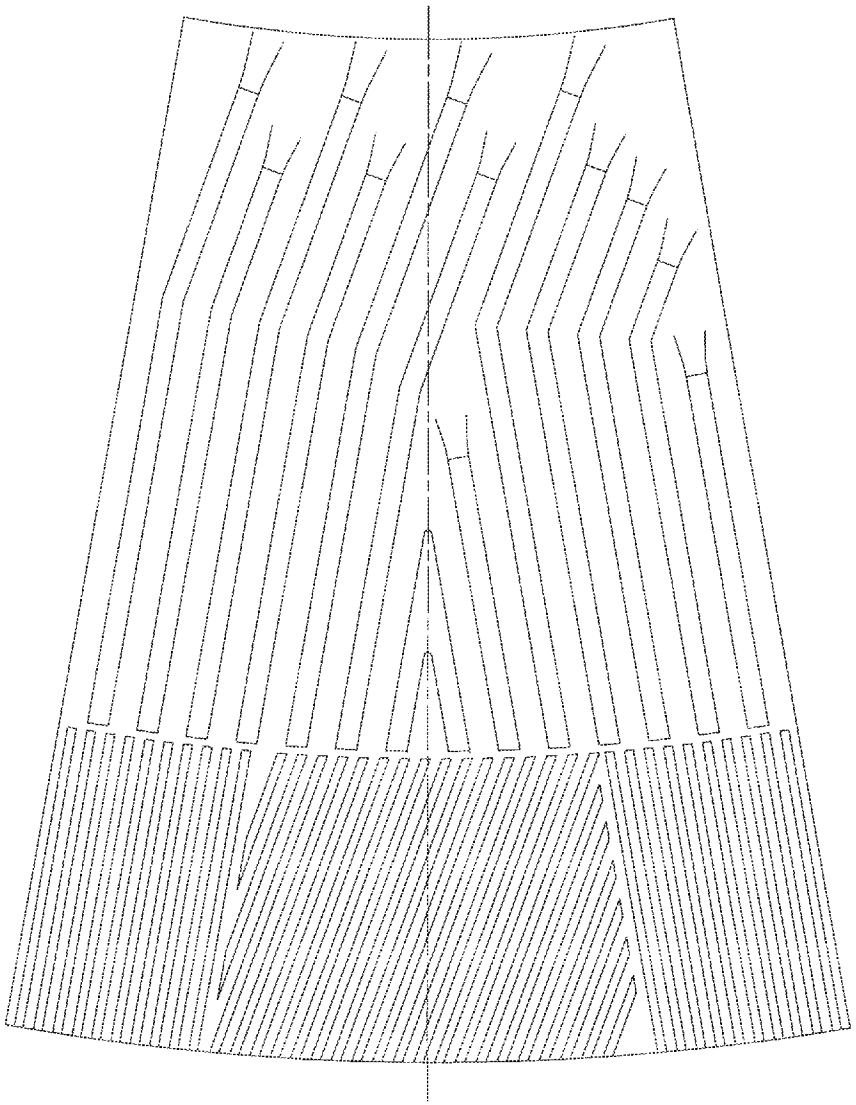
FIG. 2 is a plan view of a refiner blade segment which can be manufactured from the alloy.
Figure 3:
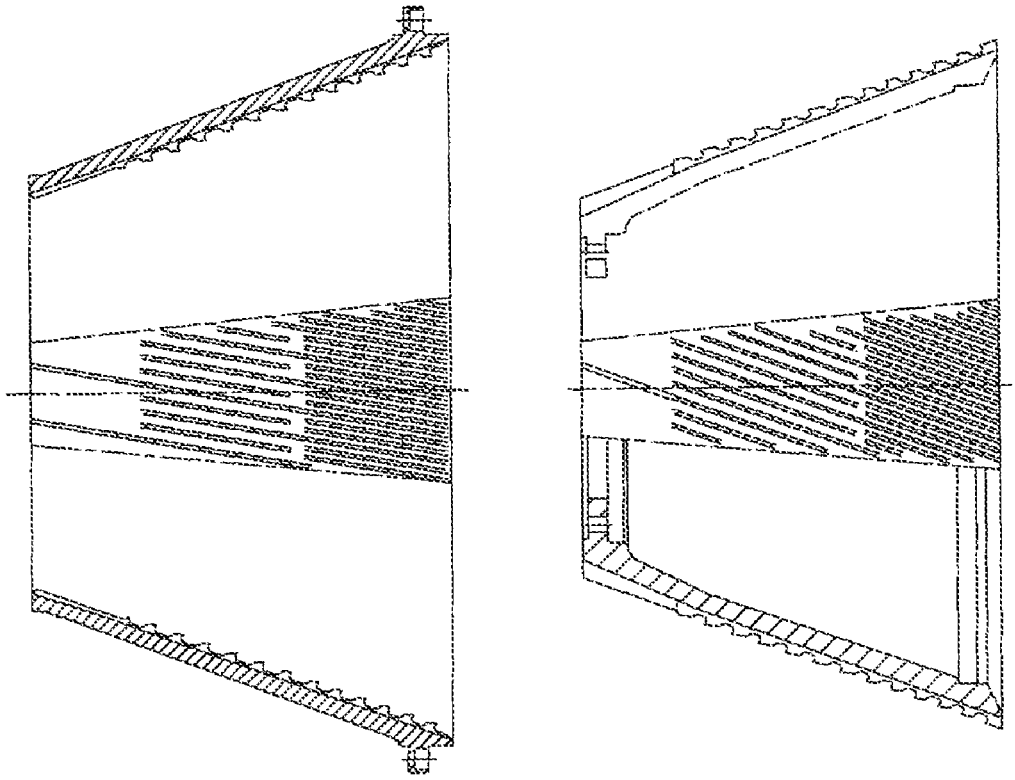
FIG. 3 shows an exploded sectional view of conical disperser blades which can be manufactured from the alloy, in the figure the stator being on the left and the rotor on the right.

In this description and in the claims, the term casting refers to the pouring of molten steel alloy into a casting mold, in which it is solidified when cooled. After it has cooled down, the molten alloy will assume the shape defined by the casting mold, including the surface configuration of the blade, such as the blade bars and grooves or any toothed shapes. A martensitic stainless steel refers to a steel grade having a martensitic crystal structure and a chromium content higher than 12 wt-%. Thus, the material of refiner or disperser blades is stainless martensitic steel.

The amounts of constituents for stainless martensitic steel according to the invention, their interaction, and the grounds for the amount of components will be presented in the following. All the alloy percentages are given by weight.

Carbon (C)

Carbon has an effect on the hardness, strength, impact ductility and abrasion resistance of the steel. It also has an effect on the corrosion resistance of the steel. The alloy must contain at least about 0.6 wt-% carbon. The alloy must contain not more than about 4 wt-% carbon. The carbon content of the alloy is advantageously about 0.8 to 3.5 wt-%, preferably 1.0 to 3.2 wt-% (including the upper and lower limits of the range), depending on the refiner application and/or the model of the blade.

It can also be presented that the carbon content in the alloy is less than 4 wt-%, the preferable carbon content can be more than 0.8 wt-% but less than 3.5 wt-%. The most preferable carbon content can be more than 1.0 wt-% but less than 3.2 wt-%.

Silicon (Si)

Silicon is used for desoxidation during the preparation of the melt. The alloy must contain at least about 0.5 wt-% silicon. However, the alloy should not contain more than about 1.5 wt-% silicon. The optimal silicon content of the alloy is about 0.8 to 1.0 wt-% including the upper and lower limits of the range. It can also be presented that the silicon content of the alloy is more than 0.5 wt-% and less than 1.5 wt-% and that the most optimal silicon content is more than 0.8 wt-% and less than 1.0 wt-%.

Manganese (Mn)

Manganese is used for desoxidation during the preparation of the melt. The alloy must contain at least about 0.4 wt-% manganese. The manganese content is restricted to a maximum of about 1.5 wt-%. The optimal manganese content of the alloy is about 0.7 to 0.8 wt-% including the upper and lower limits of the range. It can also be presented that the manganese content of the alloy is more than 0.5 wt-% and less than 1.5 wt-% and that the most optimal silicon content is more than 0.7 wt-% and less than 0.8 wt-%.

Chromium (Cr)

Chromium is an important element which has an effect on the corrosion resistance and together with carbon on the abrasion resistance. The alloy must contain at least about 12 wt-% chromium. However, the alloy should not contain more than about 28 wt-% chromium. Advantageously, the chromium content of the alloy is about 13 to 26 wt-%, most preferably 14 to 24 wt-% (including the upper and lower limits of the range), depending on the refiner application and/or the model of the blade. It can also be presented that the chromium content of the alloy is more than 12 wt-% and less than 28 wt-%. Furthermore, the chromium content is preferably more than 13 wt-% but less than 26 wt-% and most preferably the chromium content is more than 14 wt-% but less than 24 wt-%.

Nickel (Ni)

Nickel enhances the ductility of the steel. It is used depending on the refiner application and/or the model of the blade. When nickel is used, the nickel content must be not more than 2.5 wt-%, preferably 0.5 to 2.2 wt-% and most preferably 1.0 to 2.0 wt-% including the upper and lower limits of the range. It can also be presented that the nickel content is less than 2.5 wt-%. Furthermore, the nickel content is advantageously more than 0.5 wt-% but less than 2.2 wt-% and most preferably the nickel content is more than 1.0 wt-% but less than 2.0 wt-%.

Molybdenum (Mo)

Molybdenum improves the corrosion resistance of steel under oxidizing conditions. It is used depending on the refiner application and/or the model of the blade. When molybdenum is used, the molybdenum content must be not more than 2.0 wt-%, preferably 0.2 to 1.5 wt-% and most preferably 0.3 to 0.9 wt-% including the upper and lower limits of the range. It can also be presented that the molybdenum content of the alloy is less than 2.0 wt-%, preferably more than 0.2 wt-% but less than 1.5 wt-% and most preferably more than 0.3 wt-% but less than 0.9 wt-%.

Niobium (Nb)

Together with carbon, niobium easily forms niobium carbides. The forming of niobium carbides improves the abrasion resistance without substantially impairing the ductility. Niobium also decreases the forming of chromium carbides wherein the steel alloy contains more free chromium that improves the corrosion resistance of steel. The alloy must contain at least about 4 wt-% niobium. However, the alloy should not contain more than about 12 wt-% of niobium. Preferably, the niobium content is 4.5 to 10 wt-% and most preferably 5.0 to 8.0 wt-%. It can also be presented that niobium content of the alloy is more than 4 wt-%, preferably more than 4.5 wt-% but less than 10 wt-% and most preferably more than 5.0 wt-% but less than 8.0 wt-%.

During the manufacture of the blade, the niobium carbides separate first from the melt and remain evenly in the structure as separate particles and do not form lattice-like structure, which improves the impact ductility of the alloy.

The chromium/carbon ratio is important for the corrosion resistance of the blade. The niobium carbide decreases the formation of chromium carbides, and provides more free chromium that is able to dissolve in the alloy. The chromium/carbon ratio is preferably at least 7, if molybdenum is not present. The Cr/C ratio can be at least 7 even if molybdenum is present. Molybdenum can be used to further enhance the corrosion resistance.

In addition to the components mentioned above, the steel alloy does not essentially contain other deliberately added components than iron (Fe). In addition, the alloy may contain small amounts of impurities which substantially do not affect the properties of the steel.

In table 1 the most important effects to the material properties are disclosed when the amount of constituents is increased from the above-mentioned lower limits:

TABLE 1

The effects of constituents on material properties.

| Element | The change in wt-% | Ductility | Abrasion resistance | Corrosion resistance |
|---|---|---|---|---|
| C | + | − | + | − |
| Cr | + | (+) | (+) | + |
| Nb | + | + | + | (+) |

Description of signs:
+ increases
− decreases
(+) improves to some extent

As it can be seen from Table 1, increasing the amount of carbon in the steel alloy decreases ductility and corrosion resistance of steel. At the same time, the abrasion resistance increases. Increasing the amount of chromium, in turn, improves especially the corrosion resistance. Increasing niobium increases ductility, abrasion resistance and corrosion resistance.

FIG. 1 illustrates the change in properties of the steel alloy compared to a prior art steel alloy W0D0.

Thanks to the new alloy, it is possible to reach substantially better ductility without decreasing the abrasion resistance (for example the new steel alloy W0D1 shown in the chart) or, alternatively, substantially better corrosion resistance without decreasing ductility (for example the new steel alloy W1D0 shown in the chart) or, substantially better ductility and abrasion resistance. In other words, to reach the optimal properties it is possible to move along the straight line defined by points W0D1 and W1D0. The invention can be applied especially in targets in which improving the abrasion resistance without decreasing ductility is desirable.

Description of the Tests Carried Out and the Results Obtained

The examined steels were made in melt batches in production scale. The examined steels were cast to refiner blades that were subjected to thermal treatment before measuring their hardness and before refining tests. The chemical composition of the refiner blades is presented in the Table 2. In addition to the elements presented in the table, the steel contained only iron and impurities.

TABLE 2

Composition of refiner blades, wt-%

| Blade | C | Si | Mn | Cr | Ni | Mo | Nb | Hardness/HRC |
|---|---|---|---|---|---|---|---|---|
| 1 | 2.6-3.2 | 0.7-1.3 | 0.5-1.1 | 21-25 | 0 | 0.0-1.0 | 4.0-6.0 | 60-64 |
| 2 | 1.8-2.4 | 0.5-1.1 | 0.4-1.0 | 15-19 | 1.2-1.8 | 0.0-1.0 | 4.0-7.0 | not measured |
| 3 | 1.0-1.6 | 0.5-1.1 | 0.4-1.0 | 13-17 | 1.2-1.8 | 0.3-1.0 | 5.0-8.0 | 53-57 |

The refiner blades presented in Table 2 are intended to various refiner applications. Different refiner applications require different combinations of ductility and abrasion resistance. By selecting the constituents of the steel alloy in the manner presented in Table 2, the properties of the blade can be changed to suitable direction in a particular application.

Steel 1 is intended primarily for producing blades used in fiberboard refiners. By selecting the constituents of the steel alloy among the alternatives presented in Table 2, this steel has the best abrasion resistance. The hardness of the blade is 60-64 HRC, which is very high.

Steel 2 is intended primarily for producing blades used in dispersers and mechanical pulp refiners. This steel has better ductility than steel 1.

Steel 3 is intended primarily for producing blades used in low consistency refiners. This steel has the best ductility of all the alternatives presented in Table 2.

The invention is not intended to be limited to the embodiments presented as examples above, but the invention is intended to be applied widely within the scope of the inventive idea as defined in the appended claims.

The invention claimed is:

1. A refiner or disperser blade made of a steel alloy by casting, wherein the composition of the steel alloy comprises, in weight percent:

0.6 to 4 wt-% carbon (C), 0.5 to 1.5 wt-% silicon (Si), 0.4 to 1.5 wt-% manganese (Mn), 12 to 28 wt-% chromium (Cr), 4 to 12 wt-% niobium (Nb), as well as iron (Fe), whereby niobium carbides settle in the blade evenly in such a manner that does not weaken the ductility of the blade.

2. The blade of claim 1 wherein the steel alloy has a ratio of chromium/carbon of at least 7.

3. The blade of claim 1 wherein the steel alloy comprises nickel (Ni) not more than 2.5 wt-%.

4. The blade of claim 3 wherein the steel alloy comprises nickel at least 0.5 wt-%.

5. The blade of claim 3 wherein the steel alloy comprises nickel at least 1.0 wt-%.

6. The blade of claim 3 wherein the steel alloy comprises nickel not more than 2.2 wt-%.

7. The blade of claim 3 wherein the steel alloy comprises nickel not more than 2.0 wt-%.

8. The blade of claim 1 wherein the steel alloy comprises not more than 2.0 wt-% of molybdenum (Mo).

9. The blade of claim 8 wherein the steel alloy comprises molybdenum at least 0.2 wt-%.

10. The blade of claim 8 wherein the steel alloy comprises molybdenum at least 0.3 wt-%.

11. The blade of claim 8 wherein the steel alloy comprises molybdenum not more than 1.5 wt-%.

12. The blade of claim 8 wherein the steel alloy comprises molybdenum not more than 0.9 wt-%.

13. The blade of claim 1 wherein the steel alloy comprises 2.6 to 3.2 wt-% carbon, 0.7 to 1.3 wt-% silicon, 0.5 to 1.1 wt-% manganese, 21 to 25 wt-% chromium, 0.0 to 1.0 wt-% molybdenum, 4 to 6 wt-% niobium, the rest being iron and impurities.

14. The blade of claim 1 wherein the steel alloy comprises 1.8 to 2.4 wt-% carbon, 0.5 to 1.1 wt-% silicon, 0.4 to 1.0 wt-% manganese, 15 to 19 wt-% chromium, 1.2 to 1.8 wt-% nickel, 0.0 to 1.0 wt-% molybdenum, 4 to 7 wt-% niobium, the rest being iron and impurities.

15. The blade of claim 1 wherein the steel alloy comprises 1.0 to 1.6 wt-% carbon, 0.5 to 1.1 wt-% silicon, 0.4 to 1.0 wt-% manganese, 13 to 17 wt-% chromium, 1.2 to 1.8 wt-% nickel, 0.3 to 1.0 wt-% molybdenum, 5 to 8 wt-% niobium, the rest being iron and impurities.

16. The blade of claim 1 wherein the steel alloy comprises carbon at least 0.8 wt-%.

17. The blade of claim 1 wherein the steel alloy comprises carbon at least 1.0 wt-%.

18. The blade of claim 1 wherein the steel alloy comprises carbon not more than 3.5 wt-%.

19. The blade of claim 1 wherein the steel alloy comprises carbon not more than 3.2 wt-%.

20. The blade of claim 1 wherein the steel alloy comprises silicon at least 0.8 wt-%.

21. The blade of claim 1 wherein the steel alloy comprises silicon not more than 1.0 wt-%.

22. The blade of claim 1 wherein the steel alloy comprises manganese at least 0.7 wt-%.

23. The blade of claim 1 wherein the steel alloy comprises manganese not more than 0.8 wt-%.

24. The blade of claim 1 wherein the steel alloy comprises chromium at least 13 wt-%.

25. The blade of claim 1 wherein the steel alloy comprises chromium at least 14 wt-%.

26. The blade of claim 1 wherein the steel alloy comprises chromium not more than 26 wt-%.

27. The blade of claim 1 wherein the steel alloy comprises chromium not more than 24 wt-%.

28. The blade of claim 1 wherein the steel alloy contains niobium at least 4.5 wt-%.

29. The blade of claim 1 wherein the steel alloy comprises niobium at least 5.0 wt-%.

30. The blade of claim 1 wherein the steel alloy comprises niobium not more than 10 wt-%.

31. The blade of claim 1 wherein the steel alloy comprises niobium not more than 8 wt-%.

32. A mechanical pulp refiner, low consistency refiner, fiberboard refiner, or disperser comprising:

at least two rotationally symmetrical cast pieces, with the shape of a plate, cylinder or cone or combinations of these shapes placed against each other;

wherein the at least two rotationally symmetrical cast pieces are formed of a cast steel alloy which uses niobium to form niobium carbides in a martensitic structure of the steel alloy so that abrasion resistance of the two rotationally symmetrical cast pieces is improved without decreasing the cast pieces impact ductility;

wherein the cast steel alloy comprises, in weight percent:

0.6 to 4 wt-% carbon (C), 0.5 to 1.5 wt-% silicon (Si), 0.4 to 1.5 wt-% manganese (Mn), 12 to 28 wt-% chromium (Cr), 4 to 12 wt-% niobium (Nb), as well as iron (Fe), and wherein niobium carbides settle in the two rotationally symmetrical cast pieces evenly in such a manner that does not weaken the ductility of the two rotationally symmetrical cast pieces.

33. A mechanical pulp refiner, low consistency refiner, fiberboard refiner, or disperser comprising:

at least two rotationally symmetrical cast pieces, with the shape of a plate, cylinder or cone or combinations of these shapes placed against each other;

wherein the at least two rotationally symmetrical cast pieces are formed of a cast steel alloy which uses niobium to form niobium carbides in a martensitic structure of the steel alloy so that abrasion resistance of the two rotationally symmetrical cast pieces is improved without decreasing the cast pieces impact ductility;

wherein the cast steel alloy consists essentially of, in weight percent:

0.6 to 4 wt-% carbon (C), 0.5 to 1.5 wt-% silicon (Si), 0.4 to 1.5 wt-% manganese (Mn), 12 to 28 wt-% chromium (Cr), 4 to 12 wt-% niobium (Nb), nickel (Ni) not more than 2.5 wt-%, molybdenum (Mo) not more than 2.0 wt-% and iron (Fe); and wherein a ratio of chromium/carbon of at least 7 is maintained, and wherein niobium carbides settle in the two rotationally symmetrical cast pieces evenly in such a manner that does not weaken the ductility of the two rotationally symmetrical cast pieces.

* * * * *